US006365018B1

(12) United States Patent
de Nora

(10) Patent No.: US 6,365,018 B1
(45) Date of Patent: Apr. 2, 2002

(54) SURFACE COATED NON-CARBON METAL-BASED ANODES FOR ALUMINIUM PRODUCTION CELLS

(75) Inventor: Vittorio de Nora, Nassau (BS)

(73) Assignee: Moltech Invent S.A., Luxembourg (LU)

( * ) Notice: Subject to any disclaimer, the term of this patent is extended or adjusted under 35 U.S.C. 154(b) by 0 days.

(21) Appl. No.: 09/126,359

(22) Filed: Jul. 30, 1998

(51) Int. Cl.[7] ..... C25C 3/12

(52) U.S. Cl. ..... 204/243.1; 204/244; 204/245; 204/290.01; 204/290.03; 204/290.04; 204/290.05; 204/290.09; 204/290.12; 204/290.13

(58) Field of Search ..... 204/244, 245, 204/290.01, 290.11, 290.12, 290.14, 290.13, 290.03, 290.04, 293.1, 290.05, 290.09

(56) References Cited

U.S. PATENT DOCUMENTS 4,529,494 A * 7/1985 Joo et al. ..... 204/292 X
4,956,068 A * 9/1990 Nguyen et al. ..... 204/292 X
5,069,771 A * 12/1991 Nguyen et al. ..... 204/292
6,103,090 A * 8/2000 de Nora et al. ..... 204/243.1 X
6,113,758 A * 9/2000 de Nora et al. ..... 204/284

* cited by examiner

*Primary Examiner*—Donald R. Valentine
(74) *Attorney, Agent, or Firm*—Jayadeep R. Deshmukh

(57) ABSTRACT

A non-carbon, metal-based, high temperature resistant, electrically conductive and electrochemically active anode of an aluminum production cell has a metal-based substrate having an adherent coating applied prior to its immersion into the electrolyte and start up of the electrolysis. The coating is obtainable from one or more layers applied from: a liquid solution, a dispersion or suspension in a liquid or a paste, a pasty or non-pasty slurry, and combinations thereof with or without one or more further applied layers, with or without heat treatment between two consecutively applied layers when at least two layers are applied. The coating is electrically conductive after final heat treatment, and, during operation in the cell, monoatomic nascent oxygen is formed at the surface of the anode to oxidize part or most of the coating or the substrate surface, to form a barrier to ionic and gaseous oxygen and to nascent monoatomic oxygen; the coating having a slow dissolution rate in the fluoride-containing electrolyte.

28 Claims, No Drawings

SURFACE COATED NON-CARBON METAL-BASED ANODES FOR ALUMINIUM PRODUCTION CELLS

FIELD OF THE INVENTION

This invention relates to non-carbon, metal-based anodes provided with an electrochemical active surface coating for use in cells for the electrowinning of aluminium by the electrolysis of alumina dissolved in a molten fluoride-containing electrolyte, and to methods for their fabrication and reconditioning, as well as to electrowinning cells containing such anodes and their use to produce aluminium.

BACKGROUND ART

The technology for the production of aluminium by the electrolysis of alumina, dissolved in molten cryolite, at temperatures around 950° C. is more than one hundred years old.

This process, conceived almost simultaneously by Hall and Héroult, has not evolved as many other electrochemical processes.

The anodes are still made of carbonaceous material and must be replaced every few weeks. The operating temperature is still not less than 950° C. in order to have a sufficiently high solubility and rate of dissolution of alumina and high electrical conductivity of the bath.

The carbon anodes have a very short life because during electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

In the second largest electrochemical industry following aluminium, namely the chlorine and caustic industry, the invention of dimensionally stable anodes (DSA®) which were developed around 1970 permitted a revolutionary progress in chlorine cell technology resulting in a substantial increase in cell energy efficiency, in cell life and in chlorine caustic purity.

The substitution of graphite anodes with DSA® increased drastically the life of the anodes and reduced substantially the cost of chlorine production and operating the cells.

In the case of aluminium production, an additional problem is the pollution due to the materials used in the process and to the primitive cell design and operation which have remained the same over the years.

Progress has been made in the operation of modern plants which utilise cells where the gases emanating from the cells are in large part collected and adequately scrubbed and where the emission of highly polluting gases during the manufacture of the carbon anodes and cathodes is carefully controlled.

However, the frequent substitution of the anodes in the cells is still a clumsy and unpleasant operation. This cannot be avoided or greatly improved due to the size and weight of the anode and the high temperature of operation.

Thus, the dimensionally-stable anode technology used in chlorine production has not yet been successfully adapted to the aluminium electrowinning cells.

Several improvements were made in order to increase the lifetime of the anodes of aluminium electrowinning cells, usually by improving their resistance to chemical attacks by the cell environment and air to those parts of the anodes which remain outside the bath. However, most attempts to increase the chemical resistance of anodes were coupled with a degradation of their electrical conductivity.

U.S. Pat. No. 4,614,569 (Duruz et al.) describes anodes for aluminium electrowinning coated with a protective coating of cerium oxyfluoride, formed in-situ in the cell or pre-applied, this coating being maintained by the addition of cerium to the molten cryolite electrolyte. This made it possible to have a protection of the surface only from the electrolyte attack and to a certain extent from the gaseous oxygen but not from the nascent monoatomic oxygen.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective barrier layer. However, full protection of the alloy substrate was difficult to achieve.

A significant improvement described in U.S. Pat. No. 5,510,008, and in International Application WO96/12833 (Sekhar/Liu/Duruz) involved micropyretically producing a body from nickel, aluminium, iron and copper and oxidising the surface before use or in-situ. By said micropyretic methods materials have been obtained whose surfaces, when oxidised, are active for the anodic reaction and whose metallic interior has low electrical resistivity to carry a current from high electrical resistant surface to the busbars. However it would be useful, if it were possible, to simplify the manufacturing process of these materials and increase their life to make their use economic.

Metal or metal-based anodes are highly desirable in aluminium electrowinning cells instead of carbon-based anodes. As described hereabove, many attempts were made to use metallic anodes for aluminium production, however they were never adopted by the aluminium industry because of their poor performance.

OBJECTS OF THE INVENTION

An object of the invention is to reduce substantially the consumption of an applied electrochemically active anode surface coating of a metal-based non-carbon anode for aluminium electrowinning cells which coating is in contact with the electrolyte.

Another object of the invention is to provide a surface coating for a metal-based anode for aluminium electrowinning cells which in addition to a long life has a high electrochemical activity and can easily be applied onto an anode substrate.

A major object of the invention is to provide an anode for the electrowinning of aluminium which has no carbon so as to eliminate carbon-generated pollution and reduce the high cell operating costs.

SUMMARY OF THE INVENTION

The invention relates to a non-carbon, metal-based, high temperature resistant, electrically conductive and electrochemically active anode of a cell for the production of aluminium by the electrolysis of alumina dissolved in a fluoride-containing electrolyte. The anode has a metal-based substrate to which an adherent surface coating is applied prior to its immersion into the electrolyte and start up of the electrolysis by connection to the positive current supply. The coating is obtainable from one or more layers applied from: a liquid solution, a dispersion in a liquid or a paste, a suspension in a liquid or a paste, and a pasty or non-pasty slurry, and combinations thereof with or without one or more further applied layers, with or without heat treatment between two consecutively applied layers when at least two layers are applied. The coating is after final heat treatment electrically conductive and during operation in the cell electrochemically active for the oxidation of oxygen ions present at the surface of the anode to form monoatomic nascent oxygen which as such or as biatomic molecular gaseous oxygen oxidises or further oxidises the surface of the coating, or part or most of the coating or the surface of the substrate, to form a barrier to the ionic and gaseous oxygen and even a barrier to the nascent monoatomic oxygen, the coating having a slow dissolution rate in the fluoride-containing electrolyte.

In the context of this invention:

- a metal-based anode means that the anode contains at least one metal in the anode substrate as such or as alloys, intermetallics and/or cermets.
- a liquid solution means a liquid containing ionic species which are smaller than 5 nanometers and/or polymeric species of 5 to 10 nanometers and no larger particles;
- a dispersion means a liquid containing particles in colloidal form, wherein the size of the largest particles is comprised between 10 and 100 nanometers;
- a suspension means a liquid containing particles in which the largest particles are comprised between 100 and 1000 nanometers; and
- a slurry means a liquid containing particles the size of which exceeds 1000 nanometers.

The metal-based substrate is usually selected from a metal, an alloy, an intermetallic compound or a cermet. The substrate may possibly comprise stoichiometric or sub-stoichiometric compounds, in particular oxides.

Advantageously, the metal-based substrate comprises at least one metal selected from nickel, copper, cobalt, chromium, molybdenum, tantalum and iron, as a metal and/or as an oxide. For instance, the metal substrate is an alloy consisting of 10 to 30 weight % of chromium, 55 to 90% of at least one of nickel, cobalt or iron, and up to 15% of aluminium, titanium, zirconium, yttrium, hafnium or niobium.

Preferably, the metal-based substrate comprises a surface pre-coating or pre-impregnation. The pre-coating or pre-impregnation may for instance comprise ceria.

The applied layer may comprise one or more oxides, oxyfluorides, phosphides, carbides and combinations thereof such spinels, and/or perovskites. For instance. The electrochemically active layer may contain doped, non-stoichiometric and/or partially substituted spinels, the doped spinels comprising dopants selected from the group consisting $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

The oxide may be present in the electrochemically active layer as such, or in a multi-compound mixed oxide and/or in a solid solution of oxides. The oxide may be in the form of a simple, double and/or multiple oxide, and/or in the form of a stoichiometric or non-stoichiometric oxide.

The applied layer may comprise a ferrite, such as a ferrite selected from cobalt, manganese, nickel, magnesium and zinc ferrite, and mixtures thereof. The ferrite may be doped with at least one oxide selected from chromium, titanium, tin and zirconium oxide. Nickel ferrite may be partially substituted with $Fe^{2+}$.

Alternatively, the applied layer may comprise a chromite, such as a chromite selected from iron, cobalt, copper, manganese, beryllium, calcium, strontium, barium, magnesium, nickel and zinc chromite.

Advantageously, the applied layer may comprise an electrocatalyst for the formation of molecular oxygen from atomic oxygen, selected from iridium, palladium, platinum, rhodium, ruthenium, silicon, tin and zinc, the Lanthanide series and Mischmetal, and their oxides, mixtures and compounds thereof.

The layer may also comprise one or more dried colloids or polymers selected from the group consisting of colloidal alumina, silica, yttria, ceria, thoria, zirconia, magnesia, lithia, tin oxide, zinc oxide, monoaluminium phosphate or cerium acetate. The colloid or polymer may be derived from colloid or polymer precursors and reagents which are solutions of at least one salt such as chlorides, sulfates, nitrates, chlorates, perchlorates or metal organic compounds such as alkoxides, formates, acetates of aluminium, silicon, yttrium, cerium, thorium zirconium, magnesium and lithium. Possibly, the solutions of metal organic compounds, principally metal alkoxides, are of the general formula $M(OR)_z$ where M is a metal or complex cation, R is an alkyl chain and z is a number, preferably from 1 to 12. The colloid or polymer precursor or reagent may also contain a chelating agent such as acetyl acetone or ethylacetoacetate.

The invention also relates to a method of manufacturing such an anode. The method comprises forming onto a metal-based substrate one or more layers applied from: a liquid solution, a dispersion in a liquid or a paste, a suspension in a liquid or a paste, and a pasty or non-pasty slurry, and combinations thereof with or without one or more further applied layers, with or without heat treatment between two consecutively applied layers when at least two layers are applied. The coating is then exposed to a final heat treatment so as to render it electrically conductive and electrochemically active during operation in the cell.

Several techniques may be used to apply the layers such as painting, spraying, dipping, brush, electrodeposition or rollers.

A solution, dispersion, suspension or slurry may also be applied in a very liquid, a liquid, a thick or pasty form.

When several liquid-containing layers are applied, each layer may be allowed to dry at least partially in the ambient air or assisted by heating before applying the next layer.

The coating may be also formed by applying onto the metal-based substrate a precursor containing constituents which react among themselves to form the coating, and reacting the constituents to form the coating. Alternatively, the coating may be formed by applying onto the metal-based substrate a precursor containing at least one constituent which reacts with the metal-substrate to form the coating, and reacting the constituent(s) with the metal-substrate to form the coating.

A solid-applied layer may be applied onto the metal-substrate by plasma spraying, physical vapour deposition, chemical vapour deposition or calendering rollers.

The above methods may also be applied for reconditioning an anode as described above whose electrochemically active layer is worn or damaged. The method comprises clearing at least worn and/or damaged parts of the active coating from the substrate and then reconstituting at least the electrochemically active coating.

A further object of the invention is a cell for the production of aluminium by the electrolysis of alumina dissolved in a molten fluoride-containing electrolyte, such as cryolite, comprising one or more anodes as described hereabove.

Preferably, the cell comprises at least one aluminium-wettable cathode. Even more preferably, the cell is in a drained configuration by having at least one drained cathode on which aluminium is produced and from which aluminium continuously drains.

The cell may be of monopolar, multi-monopolar or bipolar configuration. A bipolar cell may comprise the anodes as described above as a terminal anode or as the anode part of a bipolar electrode.

Advantageously, the cell may comprise means to circulate the electrolyte between the anodes and facing cathodes and/or means to facilitate dissolution of alumina in the electrolyte.

The cell may be operated with the electrolyte at conventional temperatures, such as 950 to 970° C., or at reduced temperatures as low as 700° C.

Another object of the invention is a method of producing aluminium in a such a cell, comprising dissolving alumina in said fluoride-containing electrolyte and then electrolysing the dissolved alumina to produce aluminium.

DETAILED DESCRIPTION

The invention will be further described in the following Examples:

EXAMPLE 1

A polymeric slurry was prepared from: nickel-ferrite powder and a $NiOAl_2O_3$ precursor material to act as a polymeric binder for the nickel ferrite powder. The nickel-ferrite powder was specially prepared; however, commercially-available products could also have been used. The precursor $NiOAl_2O_3$ materials, solution and gel powder reacted to form the spinel $NiAl_2O_4$ at <1000° C. When applied to a suitably prepared substrate such as nickel, this slurry produced an oxide coating made from the pre-formed and the in-situ formed nickel ferrite which adhered well onto the substrate and formed a coherent coating when dried and heated. The slurry could be applied by a simple technique such as brushing or dipping to give a coating of predetermined thickness.

A nickel aluminate polymeric solution was made by heating 75 g of $Al(NO_3)_3.9\ H_2O$ (0.2 moles Al) at 80° C. to give a concentrated solution which readily dissolved 12 g of $NiCO_3$ (0.1 moles). The viscous solution (50 ml) contained 200 g/l $Al_2O_3$ and 160 g/l NiO (total oxide, <350 g/l).

This nickel-rich polymeric concentrated anion deficient solution was compatible with commercially-available alumina sols e.g. NYACOL™.

A stoichiometrically accurate $NiOAl_2O_3$ mixture was prepared by adding 5 ml of the anion deficient solution to 2.0 ml of a 150 g/l alumina sol; this mixture was stable to gelling and could be applied to smooth metal and ceramic surfaces by a dip-coating technique.

Other oxides could be suspended in the anion-deficient nickel aluminate precursor solution and applied as coatings which when heat-treated would form Ni-aluminate containing the added oxides.

An anode was made by brushing 15 layers of this slurry onto a substrate in order to obtain a final coating of a thickness of about 150 micron. The substrate consisted of 74 weight % nickel, 17 weight % chromium and 9 weight % iron, such as Inconel®. Each applied layer was allowed to dry for 10 minutes at 100° C. before applying a further layer. The slurry-brushed substrate was then submitted to a final heat treatment at 450–500° C. 15 minutes. X-ray diffraction showed nickel-aluminate had formed in the coating.

The anode was then tested in an electrolytic cell containing cryolite at 960° C. wherein alumina was dissolved in a amount of 6 weight %. After 15 hours the anode was extracted and showed no signs of substantial corrosion.

EXAMPLE 2

A colloidal solution containing a metal ferrite precursor (as required for $NiONiFe_2O_4$) was prepared by mixing 20.7 g $Ni(NO_3)_2.6\ H_2O$ (5.17 g NiO) with 18.4 g $Fe(NO_3)_3.9\ H_2O$ (4.8 g $Fe_2O_3$) and dissolving the salts in water to a volume of 30 ml. The solution was stable to viscosity changes and to precipitation when aged for several days at 20° C.

An organic solvent such as PRIMENE™ JMT ($R_3CNH_2$ molecular weight ~350) is immiscible with water and extracts nitric acid from acid and metal nitrate salt solutions. An amount of 75 ml of the PRIMENE™ JMT (2.3 M) diluted with an inert hydrocarbon solvent was mixed with 10 ml of the colloidal nickel-ferrite precursor solution. Within a few minutes the spherical droplets of feed were converted to a mixed oxide gel; they were filtered off, washed with acetone and dried to a free-flowing powder. When the gels were heated in air, nickel-ferrite formed at <800° C. and the powders could be used in colloidal slurries as described in Example I. Commercially-available nickel-ferrite powder could also have been used.

An anode was then prepared and tested as in Example 1 and showed similar results.

EXAMPLE 3

An amount of 5 g of $NiCO_3$ was dissolved in a solution containing 35 g $Fe(NO_3)_3.9\ H_2O$ to give a mixture (40 ml) having the composition required for the formation of $NiFe2O_4$. The solution was converted to gel particles by solvent extracting the nitrate with PRIMENE™ JMT as described in Example II. The nickel-ferrite precursor gels were calcinated in air to give a nickel-ferrite powder, which could be hosted into nickel-aluminate feed for coating applications from colloidal and/or polymeric slurries.

A 200 micron thick coating consisting of 15 superimposed layers was obtained on an Inconel® substrate as in Example 1 by dipping the substrate in this slurry. As in Example I, each layer was allowed to dry before applying a further layer.

The coated substrate was then submitted to a final heat treatment at 600° C. for 1 hour to consolidate the coating and form an anode.

The anode was then tested in a cell as in Example 1 and showed similar results

EXAMPLE 4

An amount of 100 g of $Cr(NO_3)_3.9\ H_2O$ was heated to dissolve the salt in its own water of crystallisation to form a solution containing 19 g $Cr_2O_3$. The solution was heated to 120° C. and 12.5 g of magnesium-hydroxy carbonate containing the equivalent of 5.0 g MgO was added. Upon stirring a solution was obtained in the form of an anion-deficient polymer mixture with a density of approximately 1.5 g/cm$^3$. An amount of 50 g of this polymer was evaporated to dryness to convert the solution into a fine oxide powder. The oxides were then calcined at 600° C. into a magnesium chromite powder.

After grinding to a fine powder, the magnesium chromite was dispersed in the polymer to form a slurry suitable for coating treated metal substrates.

An anode was then prepared and tested as in Example 3 and showed similar results.

EXAMPLE 5

An amount of 150 g of $Fe(NO_3)_3.9\ H_2O$ was heated to dissolve the salt in its own water of crystallisation to form a solution containing 29 g $Fe_2O_3$. The solution was heated to 120° C. and 18.9 g of magnesium hydroxy-carbonate dissolved in the hot solution to form 7.5 g MgO in form of an inorganic polymer together with $Fe_2O_3$. An amount of 50 g of the polymer solution was evaporated to dryness and then calcined at 600° C. yielding approximately 13 g of magnesium ferrite powder.

After calcination, the ferrite powder was ground in a pestle and mortar and then dispersed in the same inorganic polymer to give a slurry that was used to coat a treated metal substrate.

An anode was then prepared and tested as in Example 1 and showed similar results.

EXAMPLE 6

A cleaned surface of an Inconel® billet (typically comprising 74 weight % nickel, 17 weight % chromium and 9 weight % iron) was pre-coated with a ceria colloid as described in U.S. Pat. No. 4,356,106 (Woodhead/Raw), dried and heated in air at 500° C. The pre-coated billet was then further coated with the polymeric slurry described in Example 1, dried and heated in air at 500° C. The so obtained ferrite coating was very adherent and successive layers of the slurry could be applied to build up a coating of ferrite/aluminate having a thickness above 100 micron.

A similar untreated Inconel® billet was coated with a 10 micron thick layer using the polymeric slurry described in Example I but without pre-coating the billet with ceria colloid. After heat-treatment the coating was cracked and easily broke away from the substrate, which demonstrated the effect of the ceria pre-coat.

An anode was then prepared and tested as in Example 1 and showed similar results.

EXAMPLE 7

A test anode was made by coating by electro-deposition a core structure in the shape of a rod having a diameter of 12 mm consisting of 74 weight % nickel, 17 weight % chromium and 9 weight % iron, such as Inconel®, first with a nickel layer about 200 micron thick and then a copper layer about 100 micron thick.

The coated structure was heat treated at 1000° C. in argon for 5 hours. This heat treatment provides for the interdiffusion of nickel and copper to form an intermediate layer. The structure was then heat treated for 24 hours at 1000° at air to form a chromium oxide ($Cr_2O_3$) barrier layer on the core structure and oxidising at least partly the interdiffused nickel-copper layer thereby forming the intermediate layer.

A nickel-ferrite powder was made by drying and calcining at 900° C. the gel product obtained from an inorganic polymer precursor solution containing ferric nitrate and nickel carbonate. A thick paste was made by mixing 1 g of this nickel-ferrite powder with 0.85 g of a nickel aluminate polymer solution containing the equivalent of 0.15 g of oxide. This thick paste was then diluted with 1 ml of water and ground in a pestle and mortar to obtain a suitable viscosity to form a nickel-based paint.

An electrochemically active oxide layer was obtained on the core structure by applying the nickel-based paint onto the core -structure with a brush. The painted structure was allowed to dry for 30 minutes before heat treating it at 500° C. for 1 hour to decompose volatile components and to consolidate the oxide coating.

The heat treated coating layer was about 15 micron thick. Further coating layers were applied following the same procedure in order to obtain a 200 micron thick electrochemically active coating covering the core structure.

The anode was then tested in a cryolite melt containing approximately 6 weight % alumina at 970° C. by passing current at a current density of about 0.8 $A/cm^2$. After 100 hours the anode was extracted from the cryolite and showed no sign of significant internal corrosion after microscopic examination of a cross-section of the anode specimen.

What is claimed is:

1. A non-carbon, metal-based, high temperature resistant, electrically conductive and electrochemically active anode of a cell for the production of aluminium by the electrolysis of alumina dissolved in a fluoride-containing electrolyte, having a metal-based substrate to which an adherent coating is applied prior to its immersion into the electrolyte and start up of the electrolysis by connection to the positive current supply, the coating being electrically conductive and comprising one or more layers selected from:

a) layers of heat-treated liquid solutions, b) layers of heat-treated liquid and pasty dispersions, c) layers of heat-treated liquid and pasty suspensions, and d) layers of heat-treated pasty and non-pasty slurries, and combinations thereof with or without one or more further applied layers, wherein the coating comprises at least one oxide layer selected from said layers (a) to (d) which oxide layer comprises:

heat-treated inorganic polymer particles in the size range of 5 to 10 nanometers; and/or heat-treated colloidal particles the largest colloidal particles of which are in the size range of 10 to 100 nanometers, said oxide layer during operation in the cell being electrochemically active for the oxidation of oxygen ions present at the surface of the anode to form monoatomic nascent oxygen which as such or as biatomic molecular gaseous oxygen further oxidises the coating or the surface of the substrate, to form a barrier to the ionic and gaseous oxygen and at least a limited barrier to the nascent monoatomic oxygen, said coating having a slow dissolution rate in the fluoride-containing electrolyte.

2. The anode of claim 1, wherein the metal-based substrate is selected from a metal, an alloy, an intermetallic compound or a cermet.

3. The anode of claim 2, wherein the metal-based substrate comprises stoichiometric or sub-stoichiometric compounds, in particular oxides.

4. The anode claim 2, wherein the metal-based substrate comprises at least one metal selected from nickel, copper, cobalt, chromium, molybdenum, tantalum and iron, as a metal and/or as an oxide.

5. The anode of claim 4, wherein the metal-based substrate is an alloy consisting of 10 to 30 weight % of Cr, 55 to 90% of at least one of Ni, Co or Fe, and up to 15% of Al, Ti, Zr, Y, Hf or Nb.

6. The anode of claim 1, wherein the metal-based substrate comprises a surface pre-coating or pre-impregnation.

7. The anode of claim 6, wherein the pre-coating or pre-impregnation comprises ceria.

8. The anode of claim 1, wherein at least one applied layer comprises one or more oxides, oxyfluorides, phosphides, carbides and combinations thereof.

9. The anode of claim 8, wherein at least one applied layer comprises spinels, and/or perovskites.

10. The anode of claim 9, wherein the electrochemically active layer has doped, non-stoichiometric and/or partially substituted spinels, the doped spinels comprising dopants selected from the group consisting $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$and $Li^{+}$.

11. The anode of claim 9, wherein at least one applied layer comprises at least one ferrite or chromite.

12. The anode of claim 11, wherein at least one applied layer comprises a ferrite selected from the group consisting cobalt, manganese, nickel, magnesium and zinc ferrite, and mixtures thereof.

13. The anode of claim 12, wherein the ferrite is doped with at least one oxide selected from the group consisting of chromium, titanium, tin and zirconium oxide.

14. The anode of claim 12, wherein the ferrite is nickel-ferrite or nickel ferrite partially substituted with $Fe^{2+}$.

15. The anode of claim 11, wherein at least one applied layer comprises a chromite selected from iron, cobalt, copper, manganese, beryllium, calcium, strontium, barium, magnesium, nickel and zinc chromite.

16. The anode of claim 8, wherein at least one applied layer comprises an electrocatalyst for the formation of molecular oxygen from atomic oxygen, selected from iridium, palladium, platinum, rhodium, ruthenium, silicon, tin and zinc, the Lanthanide series, Mischmetal, and their oxides, mixtures and compounds thereof.

17. The anode of claim 1, wherein at least one layer comprises one or more dried colloids or polymer particles selected from the group consisting of colloidal alumina, silica, yttria, ceria, thoria, zirconia, magnesia, lithia, tin oxide, zinc oxide, monoaluminium phosphate nickel aluminate, nickel-ferrite or cerium acetate.

18. The anode of claim 17, wherein the or each colloid or polymer particles are derived from colloid or polymer precursors and reagents which are solutions of at least one salt selected from the group consisting of chlorides, sulfates, nitrates, chlorates, perchlorates or metal organic compounds selected from the group consisting of alkoxides, formates, acetates of aluminium, silicon, yttrium, cerium thorium zirconium, magnesium and lithium.

19. The anode of claim 18, wherein the or each colloid or polymer particles contain a chelating agent selected from the group consisting of acetyl acetone or ethylacetoacetate.

20. The anode of claim 18, wherein the solutions of metal organic compounds, principally metal alkoxides, are of the general formula $M(OR)_z$ where M is a metal or complex cation, R is an alkyl chain and z is a number, preferably from 1 to 12.

21. A cell for the production of aluminium by the electrolysis of alumina dissolved in a fluoride-containing electrolyte comprising at least one anode according to claim 1.

22. The cell of claim 21, wherein the electrolyte is cryolite.

23. The cell of claim 21, comprising at least one aluminium-wettable cathode.

24. The cell of claim 23, which is in a drained configuration.

25. The cell of claim 24, comprising at least one drained cathode on which aluminium is produced and from which aluminium continuously drains.

26. The cell of claim 21, which is in a bipolar configuration and wherein the anodes form the anodic side of at least one bipolar electrode and/or a terminal anode.

27. The cell of claim 21, comprising means to circulate the electrolyte between the anodes and facing cathodes and/or means to facilitate dissolution of alumina in the electrolyte.

28. The cell of claim 21, wherein during operation the electrolyte is at a temperature of 700° C. to 970° C.

* * * * *